US011624579B2

(12) United States Patent
Bridgman, Jr.

(10) Patent No.: US 11,624,579 B2
(45) Date of Patent: Apr. 11, 2023

(54) HANDGUN GUARD AND METHOD OF USE THEREOF

(71) Applicant: Lee H. Bridgman, Jr., North Pole, AK (US)

(72) Inventor: Lee H. Bridgman, Jr., North Pole, AK (US)

(73) Assignee: Alaskan Gun Guard, LLC, North Pole, AK (US)

( * ) Notice: Subject to any disclaimer, the term of this patent is extended or adjusted under 35 U.S.C. 154(b) by 103 days.

(21) Appl. No.: 16/858,600

(22) Filed: Apr. 25, 2020

(65) Prior Publication Data

US 2020/0348102 A1 Nov. 5, 2020

Related U.S. Application Data

(60) Provisional application No. 62/920,394, filed on Apr. 26, 2019.

(51) Int. Cl.

| | |
|---|---|
| ***F41A 35/02*** | (2006.01) |
| ***F41C 33/04*** | (2006.01) |
| ***F41C 33/02*** | (2006.01) |

(52) U.S. Cl.

CPC ..... *F41A 35/02* (2013.01); *F41C 33/0209* (2013.01); *F41C 33/041* (2013.01)

(58) Field of Classification Search

CPC .. F41C 33/0218; F41C 33/0263; F41A 35/02; A01K 89/00; A63B 60/62

See application file for complete search history.

(56) References Cited

U.S. PATENT DOCUMENTS

| | | | | |
|---|---|---|---|---|
| 2,704,563 | A * | 3/1955 | Henrich | A63B 55/406 150/159 |
| 4,660,610 | A * | 4/1987 | McIntire, III | B23K 37/00 150/161 |
| 5,005,623 | A * | 4/1991 | Webster, Jr. | A63B 55/406 150/159 |
| 6,321,805 | B1 * | 11/2001 | Suggs | A63B 60/62 150/160 |
| 9,933,234 | B1 * | 4/2018 | Shows | F41C 33/04 |
| 10,240,894 | B1 * | 3/2019 | Shows | F41C 33/0236 |
| 2014/0027479 | A1 * | 1/2014 | Hogue | F41C 33/029 224/183 |
| 2014/0305975 | A1 * | 10/2014 | Ribas | F41C 33/0263 224/244 |

* cited by examiner

*Primary Examiner* — Corey N Skurdal
(74) *Attorney, Agent, or Firm* — Technology Law, PLLC

(57) ABSTRACT

A device for the protection of a handgun carried in an open top holster includes a hood having a slot extending from the mouth of the hood up one side of the hood so that the device can be slid over a handgun carried in an open top holster to protect the handgun from elements such as rain and dust.

12 Claims, 4 Drawing Sheets

HANDGUN GUARD AND METHOD OF USE THEREOF

CROSS-REFERENCE TO RELATED APPLICATION

This application claims the benefit of U.S. Provisional Application No. 62/920,394, filed Apr. 26, 2019, and which is hereby incorporated by reference in its entirety.

TECHNICAL FIELD

This disclosure relates to the protection of a handgun carried in an open holster.

BACKGROUND

Handgun holsters comprise flap holsters and open top holsters. Flap holsters protect a handgun from elements such as rain and dust but are not used by competitive handgun shooters. The holster used by competitive handgun enthusiasts is usually a special type of open top holster permitting fast draw of the handgun from the holster. The handguns used by competitive handgun enthusiasts are finely crafted and expensive. Competitive handgun enthusiasts can find themselves competing in harsh conditions and unable to properly protect their high value handgun while on their gun belts. The competitive handgun shooter might use a plastic bag or a shower cap to protect his/her handgun from the elements but plastic bags and shower caps are far from a satisfactory solution to the problem.

SUMMARY

A handgun guard is provided herein for use with a holster assembly having a holster configured to at least partially contain a handgun, a clip configured to attach to an article of clothing, and a member interconnecting the holster to the clip. The handgun guard comprises material defining a cavity, an opening to the cavity, and a slot contiguous with the opening. The cavity, slot, and opening are sized and positioned such that the holster with the handgun therein is insertable into the cavity through the opening and the member is extendable through the slot.

The material protects the handgun and holster within the cavity, and the slot accommodates the member that connects the holster to the clip; in use, the member extends out of the cavity through the slot. Accordingly, the handgun guard may be used when the holster is being worn by a person, such as when the clip is attached to a belt of the waistline of pants. A hook and loop strap may extend across the slot underneath the member to retain the handgun guard in place.

The configuration of the material permits the handgun guard to be used without modification on either a shooter's left side or right side, and therefore the handgun guard may be used for both left-handed shooter and right-handed shooters. Further, the cavity is sufficiently large that the handgun guard can be used with almost any handgun size or configuration.

A corresponding method of using the handgun guard is also provided.

The above features and advantages and other features and advantages of the present disclosure are readily apparent from the following detailed description of the best modes for carrying out the disclosure when taken in connection with the accompanying drawings

DESCRIPTION OF THE PREFERRED EMBODIMENTS

Figure 1:
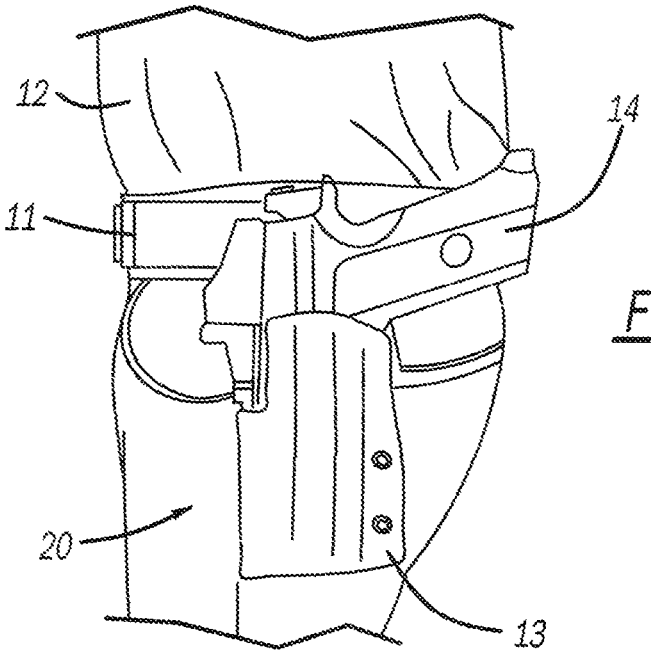
FIG. 1 is a schematic, side view of a person carrying a competitive handgun in an open top holster.
Figure 2:
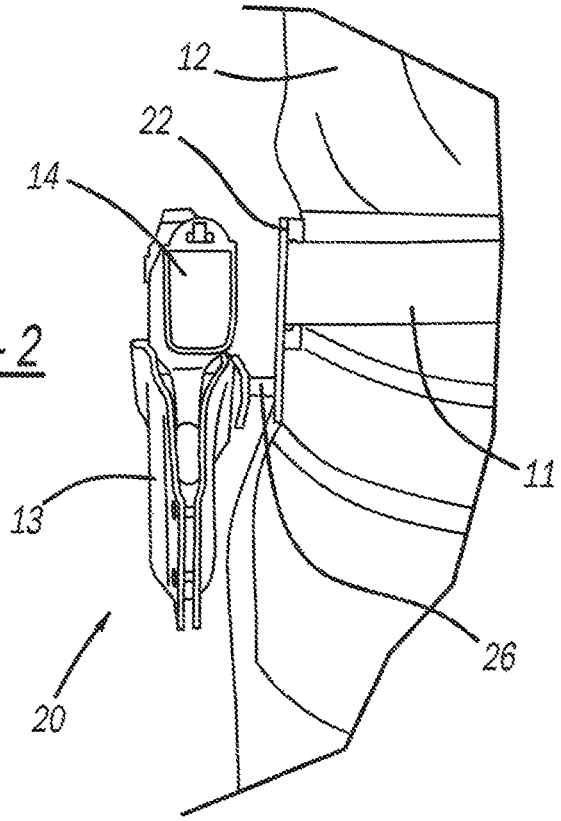
FIG. 2 is a schematic, rear view of a person carrying a competitive handgun in an open top holster.

Referring now to FIGS. 1 and 2, therein is shown a person 12 carrying a competitive handgun 14 in open top holster 13 carried on belt 11. It should be noted that, although a competitive handgun is shown and described, the claimed invention may be employed with any handgun. More specifically, the person 12 is wearing a belt 11 around his/her waist, as understood by those skilled in the art. The holster 13 defines an upwardly-open cavity in which the handgun 14 is disposed. The holster 13 is part of a holster assembly 20, which also includes a clip 22 and a substantially rigid member 26 that interconnects the clip 22 and the holster 13. The clip 22 is configured for releasable attachment to the belt 11 or other article of clothing, such as the waist of a pair of pants. The clip 22 may have any configuration for attaching to an article of clothing within the scope of the claimed invention, including but not limited to, a member defining an aperture through which the belt 11 may extend.

Figure 3:
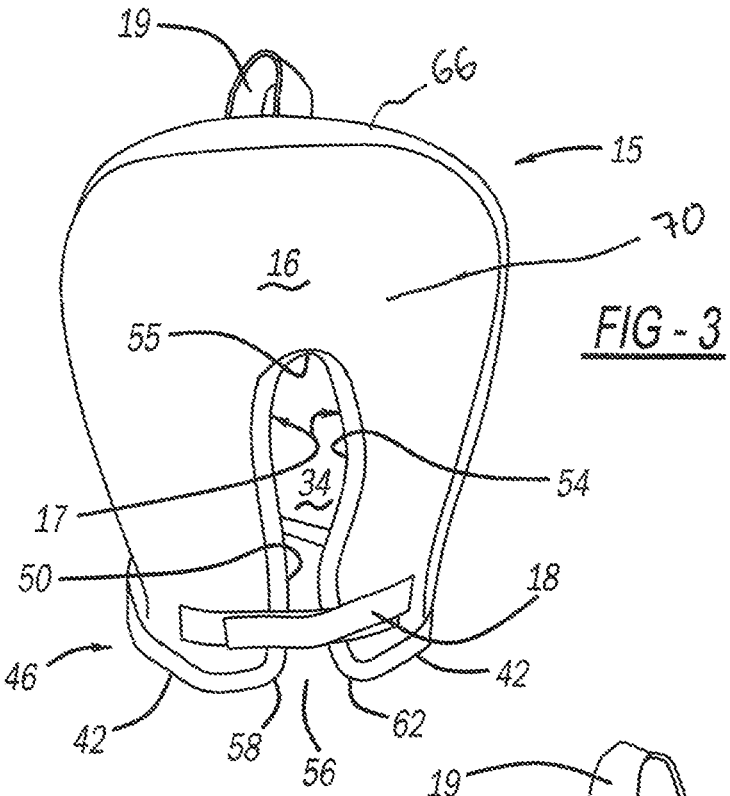
FIG. 3 is a schematic, rear view of a handgun guard for use with the handgun of FIGS. 1 and 2 in accordance with the claimed invention.
Figure 4:
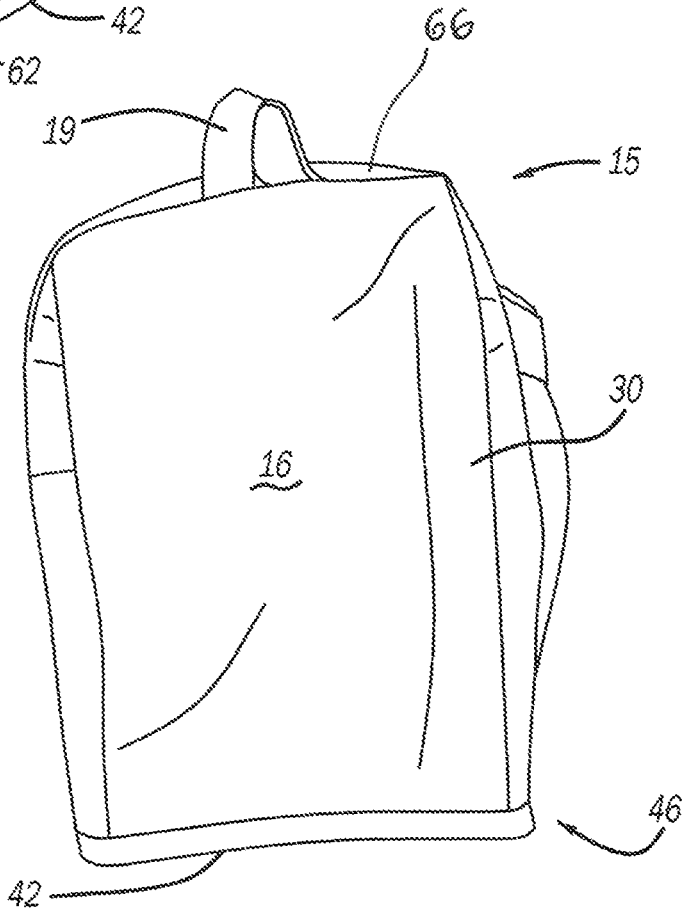
FIG. 4 is a schematic, front view of the handgun guard.
Figure 5:
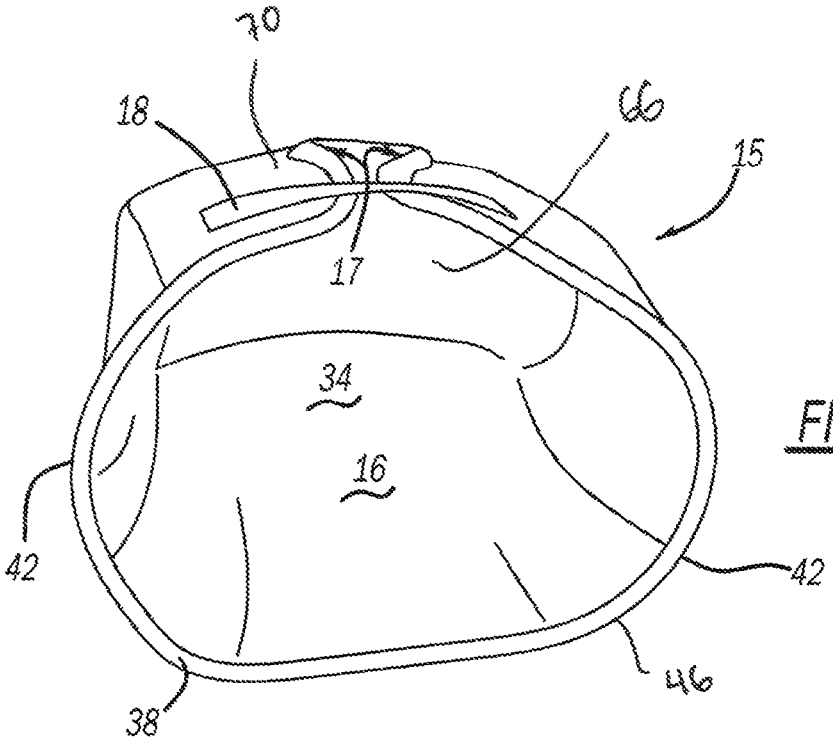
FIG. 5 is a schematic, bottom view of the handgun guard.

Referring now to FIGS. 3-5, wherein like reference numbers refer to like components, a handgun guard 15 includes a hood 16 comprising slot 17 extending from the mouth of the hood up the side of the hood. The slot allows the device 15 to slide easily over a competitive handgun in an open top holster. Strap 18 is attached to the hood 16 to secure the slot 17 at the mouth of the hood.

Figure 6:
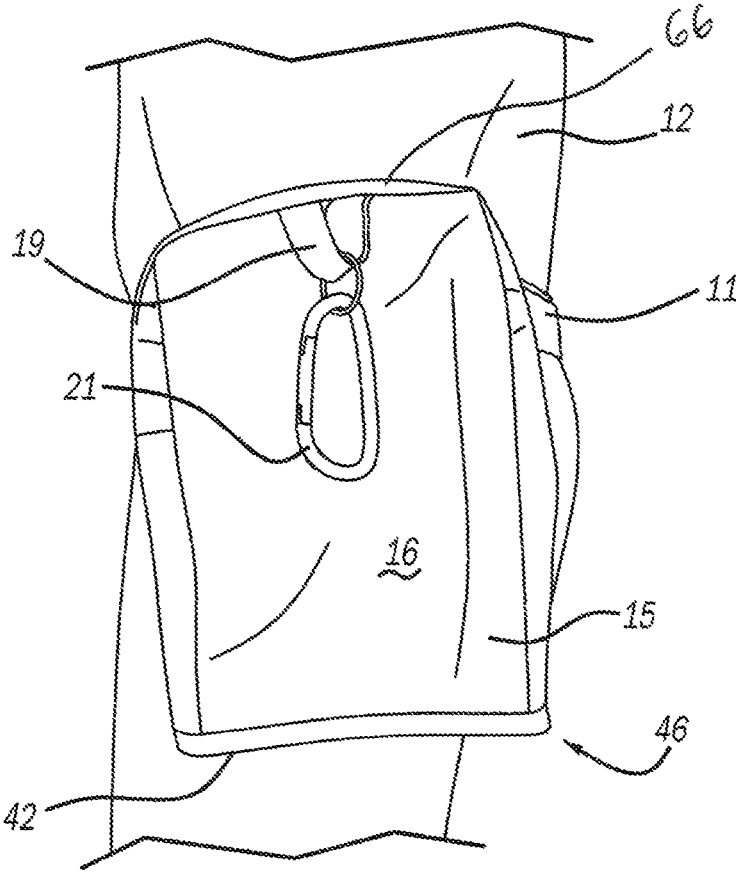
FIG. 6 is a schematic, side view of the handgun guard in use with the handgun and holster of FIGS. 1 and 2.
Figure 7:
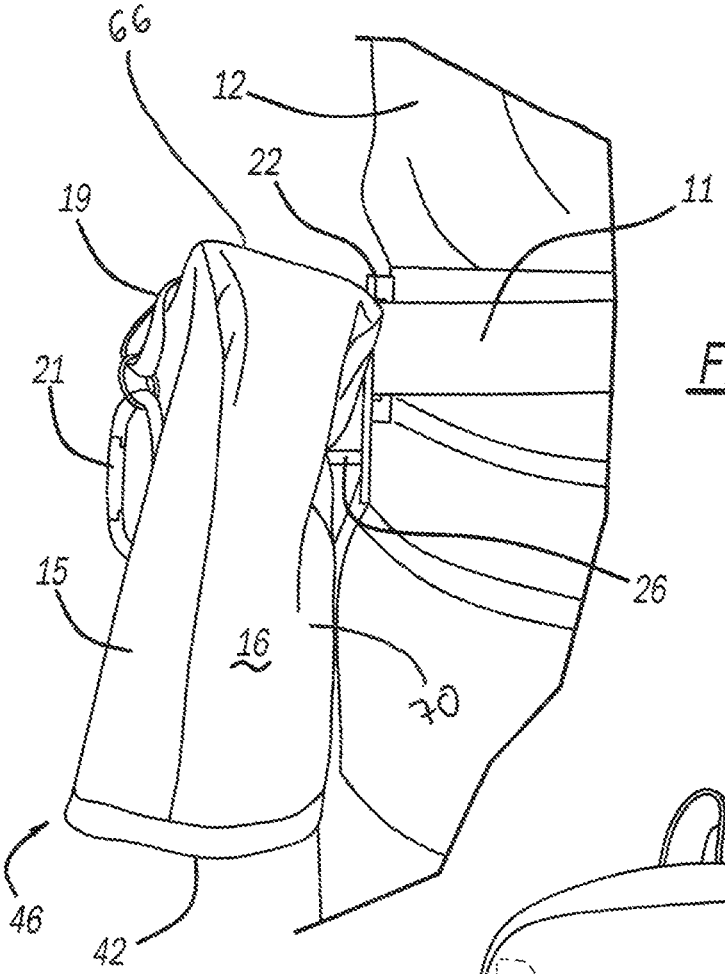
FIG. 7 is a schematic, rear view of the handgun guard in use with the handgun and holster of FIGS. 1 and 2.

FIGS. 6-7, wherein like reference numbers refer to like components from FIGS. 1-5, depict the person 12 employing the handgun guard 15 with the holster 13 to protect the handgun 14. Referring to FIGS. 6 and 7, loop 19 can be used for the attachment of, for example and without limitation thereto, a carabiner 21 as shown and to facilitate removal of the device.

The components of the instant invention can be made of any suitable material. The hood is preferably made from 600 denier UV protected canvas with a PVC backing for waterproofing. The hood 16 can be ten inches tall, three inches deep and seven inches wide (eight inches wide if the handgun is equipped with optical sights). The slot 17 in the hood 16 can be six inches long. The strap 18 is preferably closed by a hook-and-loop fastener system such as the well-known VELCRO brand fastening system. The side of the hood 16 can be marked with, for example and without limitation thereto, a team logo or the name of the owner.

Thus, the hood 16 is comprised of a flexible material 30 which defines a cavity 34. The material 30 defines a mouth, or opening 38, to the cavity 34. The material 30 defines a slot 17 that is contiguous with the opening 38 and that extends longitudinally with respect to the hood 16.

More specifically, the material 30 includes a first edge 42 that defines the opening 38 at one end 46 of the hood 16. The material 30 also defines a second edge 50 and a third edge 54. The second edge 50 and the third edge 54 extend longitudinally with respect to the hood 16. The second edge 50 and the third edge 54 cooperate with each other to define the slot 17 therebetween. The second edge 50 and the third edge 54 both extend from the first edge 42. An opening 56 to the slot 17 is defined between the intersection 58 of the first and second edges 42, 50 and the intersection 62 of the first and third edges 42, 54. It should be noted that material 30 may be a single piece of material, or may be multiple pieces of material connected together such a by stitching or adhesive bonding. In the embodiment depicted, material 30 includes trim pieces forming the opening 38 and slot 17.

Figure 8:
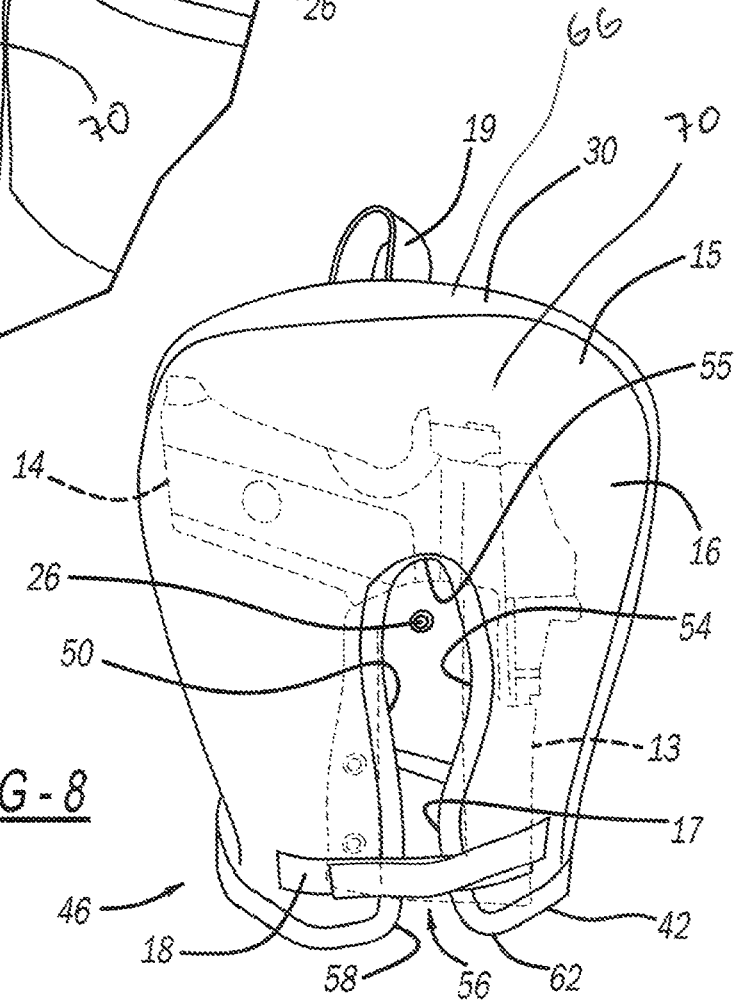
FIG. 8 is a schematic, sectional, rear view of the handgun guard in use with the holster taken about a vertical plane extending through a member attaching the holster to a clip.

A method of using the handgun guard 15 includes possessing the handgun guard, and inserting the handgun 14 and the holster 13 into the cavity 34 through the opening 38 such that the member 26 extends through the slot 17, as shown in FIG. 8. The opening 56 to the slot 17 permits a user to perform this step while wearing the holster assembly 22 by having the member 26 enter the slot 17 through the opening 56 while the handgun 14 and holster 13 are being inserted into the cavity 34.

The method may also include using a fastener, i.e., strap 18, to connect edge 50 and edge 54 as shown in FIG. 8, such that the member 26 is between the strap 18 and the termination 55 of the slot 17. With the member 26 trapped between the termination 55 of the slot 17 and the strap 18, the handgun guard 15 is secured to the holster assembly 20.

The edge 42 defining the opening 38 is at the lower, or bottom, end 46 of the hood 16; accordingly, the step of inserting the handgun 14 and holster 13 into the cavity 34 through the opening 38 may include lowering the hood 16 over the handgun 14 and holster 13. The upper, or top, end 66 is closed by material 30; the only openings to the cavity 34 are the opening 38 and the slot 17, so that the handgun 14 and holster 13 are almost entirely surrounded and protected by the material 30. The slot 17 extends up the middle of the rear face 70 of the hood 16 so that the handle of the handgun 14 may extend in either direction within the cavity 34; accordingly, the handgun guard 15 may be used on either the left side or the right side of the person 12. The length and width of the hood 16 and cavity 34 are substantially constant along the height of the hood 16.

While the best modes for carrying out the invention have been described in detail, those familiar with the art to which this invention relates will recognize various alternative designs and embodiments for practicing the invention within the scope of the appended claims.

The invention claimed is:

1. A method of protecting a handgun in a holster that is connected by a member to a clip, said clip being configured to attach to an article of clothing, the method comprising:

possessing a handgun guard having material defining a cavity, an opening to the cavity, and a slot that is contiguous with the opening;

lowering the handgun guard over the handgun and the holster when the clip is attached to a belt or other article of clothing such that the handgun and the holster enter the cavity through the opening and the member enters the slot.

2. The method of claim 1, wherein the slot is defined by a first edge of the material and a second edge of the material; and wherein the handgun guard further comprises a fastener being selectively engageable to connect the first edge and the second edge.

3. The method of claim 2, wherein the fastener is a hook and loop strap.

4. The method of claim 2, wherein the material is flexible.

5. The method of claim 4, wherein the material includes fabric.

6. A method of protecting a handgun in a holster that is connected to a clip by a member, the method comprising:

possessing a handgun guard having material defining a cavity, an opening to the cavity, and a slot that is contiguous with the opening; and inserting the handgun and the holster into the cavity through the opening such that the member extends through the slot.

7. The method of claim 6, further comprising using a fastener to connect one side of the slot to the other side of the slot.

8. The method of claim 7, wherein the fastener is a hook and loop strap.

9. The method of claim 8, wherein the strap is below the member.

10. The method of claim 6, wherein the clip is connected to an article of clothing.

11. The method of claim 6, wherein said inserting the handgun and the holster into the cavity through the opening includes lowering the handgun guard over the handgun and the holster when the clip is attached to an article of clothing.

12. The method of claim 11, wherein said lowering the handgun guard over the handgun and the holster includes lowering the handgun guard over the handgun and the holster such that the handgun and the holster enter the cavity through the opening and the member enters the slot.

* * * * *